US006340413B1

(12) United States Patent
Nilsson et al.

(10) Patent No.: US 6,340,413 B1
(45) Date of Patent: Jan. 22, 2002

(54) EMBOSSING BELT FOR A PAPER MACHINE

(75) Inventors: Göran Nilsson, Oskarström; Bo-Christer Åberg, Halmstad, both of (SE)

(73) Assignee: Albany International AB, Halmstad (SE)

( * ) Notice: Subject to any disclaimer, the term of this patent is extended or adjusted under 35 U.S.C. 154(b) by 0 days.

(21) Appl. No.: 09/665,632

(22) Filed: Sep. 19, 2000

Related U.S. Application Data

(63) Continuation of application No. PCT/SE99/00435, filed on Mar. 19, 1999.

(30) Foreign Application Priority Data

Mar. 20, 1998 (SE) ..... 9800947

(51) Int. Cl.[7] ..... D21F 3/00

(52) U.S. Cl. ..... 162/361; 162/900; 162/901; 162/902; 162/358.2; 442/268

(58) Field of Search ..... 162/289, 309, 162/902, 109, 306, 362, 402, 358.2, 358.1, 361, 903, 905; 428/153, 225, 233; 442/320, 268, 86, 85, 270, 271, 275

(56) References Cited

U.S. PATENT DOCUMENTS

| | | | | |
|---|---|---|---|---|
| 3,301,746 A | | 1/1967 | Sanford et al. | |
| 3,537,954 A | | 11/1970 | Justus | |
| 4,087,319 A | | 5/1978 | Linkletter | |
| 4,309,246 A | | 1/1982 | Hulit et al. | |
| 4,483,745 A | | 11/1984 | Wicks et al. | |
| 4,500,588 A | | 2/1985 | Lundstrom | |
| 4,529,643 A | | 7/1985 | Lundstrom | |
| 4,533,437 A | | 8/1985 | Curran et al. | |
| 4,849,054 A | | 7/1989 | Klowak | |
| 4,921,750 A | * | 5/1990 | Todd | 428/225 |
| 4,976,821 A | | 12/1990 | Laapotti | |
| 5,002,638 A | | 3/1991 | Gulya et al. | |
| 5,211,815 A | * | 5/1993 | Ramasubramanian et al. | 162/348 |
| 5,298,124 A | | 3/1994 | Eklund et al. | |
| 5,393,384 A | | 2/1995 | Steiner et al. | |
| 5,411,636 A | | 5/1995 | Hermans et al. | |
| 5,542,455 A | * | 8/1996 | Ostermayer et al. | 139/383 |
| 5,569,358 A | | 10/1996 | Cameron | |
| 5,591,305 A | | 1/1997 | Cameron | |
| 5,628,876 A | * | 5/1997 | Ayers et al. | 162/358.2 |
| 6,010,598 A | * | 1/2000 | Boutilier et al. | 162/348 |
| 6,036,819 A | * | 3/2000 | Miller et al. | 162/358.2 |
| 6,136,151 A | * | 10/2000 | Davenport et al. | 162/306 |
| 6,193,847 B1 | * | 2/2001 | Trokhan | 162/358.1 |

FOREIGN PATENT DOCUMENTS

| | | |
|---|---|---|
| CA | 1188556 | 6/1985 |
| DE | 195 48 747 A1 | 7/1997 |
| SE | 9800949-1 | 3/1998 |
| WO | WO91/16493 | 10/1991 |

* cited by examiner

*Primary Examiner*—Peter Chin
*Assistant Examiner*—Carlos Lopez
(74) *Attorney, Agent, or Firm*—Pitney, Hardin, Kipp & Szuch LLP

(57) ABSTRACT

An embossing belt for a paper machine, intended to run through a press section in the paper machine together with a fibrous web and produce an embossment thereof in the press section, and to transfer the embossed fibrous web from the press section directly to and through a transfer means in the dryer section of the paper machine. The embossing belt is essentially impermeable and comprises a rear layer (33) and a web-contacting layer (34), which has a large number of uniformly distributed depressions (35) and, positioned therebetween, surface portions (36) for forming a corresponding relief pattern in the fibrous web passing through the press section.

15 Claims, 7 Drawing Sheets

EMBOSSING BELT FOR A PAPER MACHINE

CROSS REFERENCE TO RELATED APPLICATION

Figure 1:
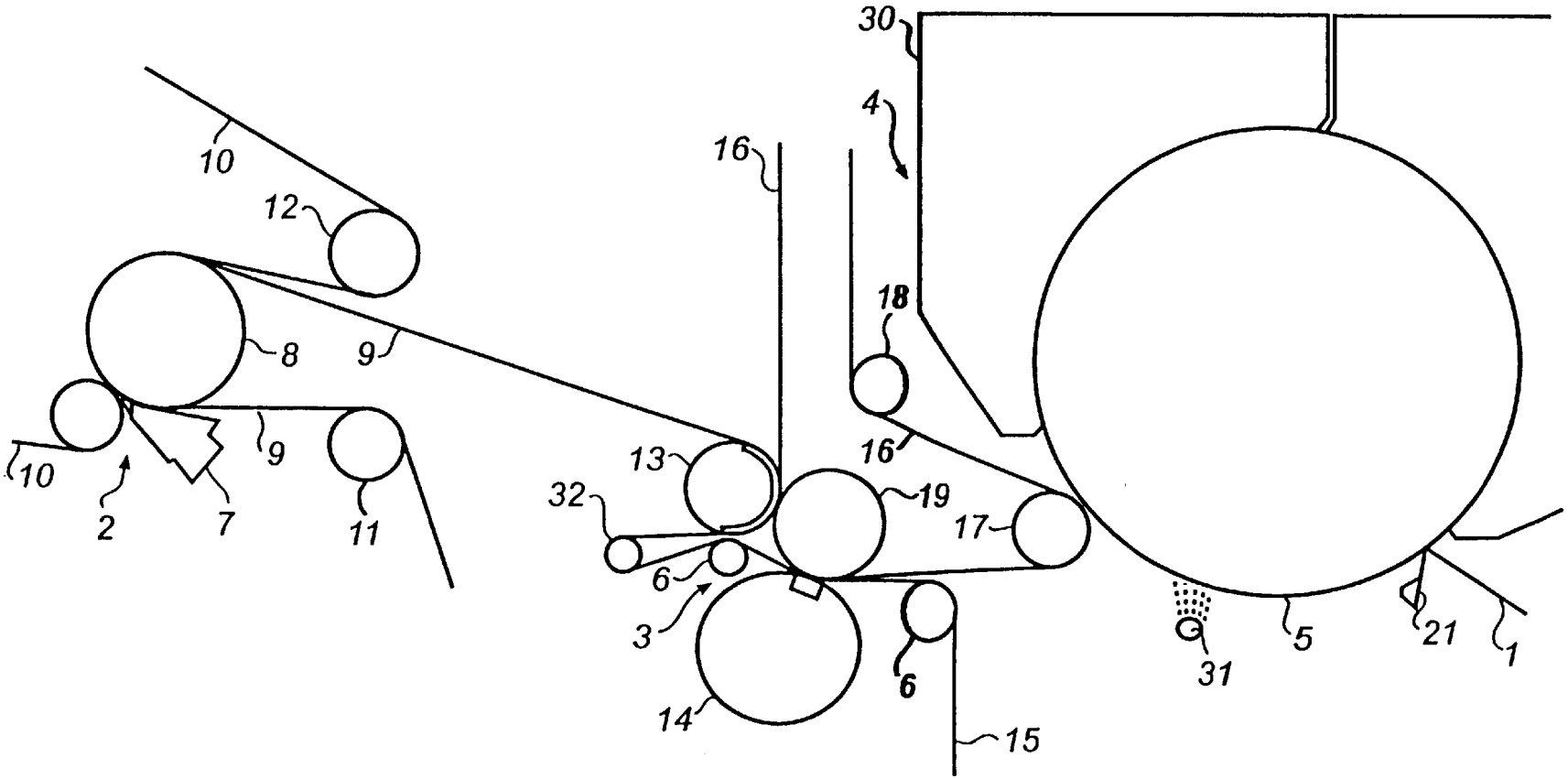

This is a continuation of International Application No. PCT/SE99/00435, which was filed on Mar. 19, 1999 and in which the United States was designated.

The present invention relates to an embossing belt for paper machines for manufacturing an embossed paper web.

DE-195 48 747 discloses a paper machine for making creped tissue, which has a press comprising a shoe press roll, a counter roll and a suction roll, the counter roll forming a first press nip with the suction roll and a second extended press nip with the shoe press roll. A felt runs through the two press nips together with the paper web and then brings along the paper web to a Yankee cylinder, to which the paper web is transferred when the felt and the paper web pass round a transfer roll, which forms a non-compressing nip with the Yankee cylinder. Suction zones for dewatering the felt are available before and after the first press nip, the suction zone before the press nip being located inside the suction roll while the suction zone after the press nip is located in a side loop, in which the felt runs alone to meet again the paper web at the entry of the second press nip. Such a paper machine is inconvenient since the paper web is rewet by the wet felt before it reaches the Yankee cylinder.

U.S. Pat. No. 5,393,384 discloses a paper machine for producing a tissue web, which in the embodiment according to FIG. 6 comprises a non-compressible, water-impermeable belt, the underside of which conducts a paper web through a shoe press nip and from there to a Yankee cylinder, via a transfer roll which forms a nip with the Yankee cylinder. This impermeable belt has a smooth web-carrying surface which makes an adhesive water film form thereon as the belt passes through the press nip together with a press felt which has a non-smooth surface in contact with the paper web. As is known, a Yankee cylinder has a smooth surface. Since both the Yankee cylinder and the impermeable belt have smooth surfaces which the paper web is intended to contact, there is a risk that the paper web continues to adhere to the smooth surface of the impermeable belt after having passed the nip adjacent to the Yankee cylinder instead of being transferred, as desired, to the smooth surface of the dryer cylinder. Not even if large amounts of adhesive are applied to the circumferential surface of the dryer cylinder will it be possible to ensure that the paper web adheres to the Yankee cylinder.

U.S. Pat. No. 5,298,124 produces an excellent presentation of the tasks which a transfer belt in corporation with a press felt should perform in a satisfactory manner, as well as the properties and construction of such transfer belts which were then disclosed in Patent Publications U.S. Pat. Nos. 4,483,745; 4,976,821; 4,500,588; 5,002,638; 4,529,643 and CA-A-1,188,556.

The critical tasks, according to U.S. Pat. No. 5,298,124, of a transfer belt intended for cooperation with a press fabric comprise a) removing the paper web from the press fabric without causing instability problems; b) cooperating with the press fabric in one or more nips to ensure optimal dewatering and a high quality of the paper web; and c) transferring the paper web in a closed draw from a press in the press section to a paper-receiving wire or belt in the subsequent press (presses) in the press section, or to a pick-up wire in the dryer section.

Figure 2:
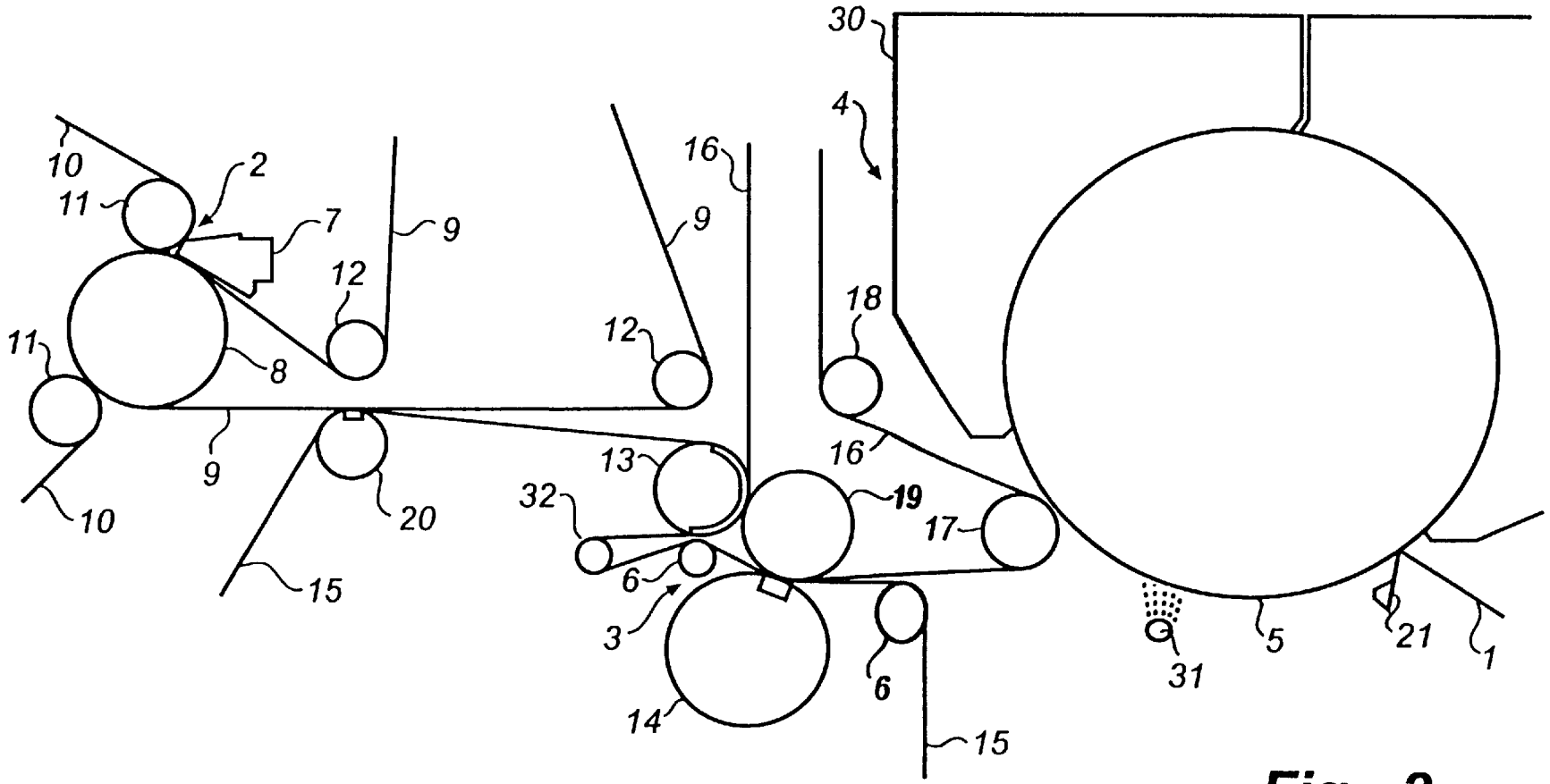

U.S. Pat. No. 5,298,124 suggests a transfer belt for the press section in a paper machine having a specific design, and such a transfer belt is shown and described for operation in three paper machines with different press sections, the belt transferring the paper web from the press section to a dryer fabric which brings the transferred web to a dryer cylinder. In FIG. 2 of this publication, the press section has a shoe press nip as the last press nip.

The transfer belt disclosed in U.S. Pat. No. 5,298,124 for the press section of a paper machine has a web-contacting surface which is essentially impermeable to water and air and which has a pressure-responsive microscale topography. Under the action of the pressure in a press nip of the press section, the transfer belt is compressed such that the microscale roughness of said surface decreases, making the surface much smoother and allowing a thin, continuous film of water to be built up between the paper web and said surface. The thin, continuous film of water provides much stronger adhesive forces between the paper web and the transfer belt than between the paper web and the press fabric, so that the paper web may reliably follow the transfer belt as the paper web leaves the press nip. In this connection, the transfer belt expands in the direction of thickness and approaches its non-compressed state such that the film of liquid on said web-contacting surface breaks up.

Paper machines for manufacturing high bulk soft tissue are known from a plurality of patent specifications. As a rule, an embossing fabric or embossing felt is used, which together with the formed paper web runs through a press nip, in which the paper web as pressed into the embossing fabric and in this way obtains an embossed pattern on one side. Paper machines having such embossing fabrics and press nips are disclosed in U.S. Pat. No. 3,301,746, U.S. Pat. No. 3,537,954, U.S. Pat. No. 4,309,246, U.S. Pat. No. 4,533,437, U.S. Pat. No. 5,569,358, U.S. Pat. No. 5,591,305 and WO 91/16493. A drawback of paper machines according to these publications is that the dewatering in the press nip is relatively low such that the dry solids content of the paper web is low as the paper web is transferred to the dryer cylinder, which results in a relatively low production rate of the paper machine.

U.S. Pat. No. 4,849,054 discloses a machine for manufacturing an embossed high bulk fibrous web without using a press nip. A roll, such as a transfer roll or a felt-carrying roll, forms a nip with an embossing fabric in a transfer point of the web where the embossing fabric runs round a vacuum tube which has a slot opening directed towards the transfer point. The nip is so wide that the web is not compressed when running therethrough. The suction of the vacuum tube via the narrow slot opening is sufficient so as not only to transfer the web to the embossing belt but also to conform the web to the embossing belt surface facing the web and having a three-dimensional pattern. Before the transfer point, the fibrous web has a speed which is higher than that of the embossing fabric. The roll carrying the web up to the non-compression nip has a smooth surface, and it is commonly known that in practice great problems are involved in the transfer of a fibrous web from a smooth surface to a fabric, said fibrous web being pre-pressed to a dry solids content of 30–50%.

U.S. Pat. No. 5,411,636 discloses the manufacture of tissue paper, in which the paper web is formed on a forming fabric, pre-pressed in a double-felted press nip and transferred to a coarse mesh fabric. When the paper web is supported by the coarse mesh fabric, it is subjected, in a suction zone, to vacuum, such that the paper web is sucked into the openings and depressions of the fabric, so that the paper web obtains an increased thickness and, thus, increased bulk. The coarse mesh fabric then carries the paper web to the dryer cylinder. The double-felted press nip implies that the dry solids content of the paper web after the press nip is relatively low, in fact 25–30%. Since no dewatering can be carried out in the nip adjacent to the dryer cylinder, the dry solids content of the paper web in the transfer to the drying cylinder is correspondingly low. Moreover, it is most uncertain whether the paper web is really transferred from the felt to the coarse mesh fabric.

An object of the present invention is to provide an improved embossing belt, by means of which it is possible to manufacture an embossed fibrous web having a high bulk and a high dry solids content before the Yankee cylinder, thereby achieving a high production rate at a reasonable cost, and in a reliable manner also transfer the embossed fibrous web to the Yankee cylinder.

The object is achieved by an embossing belt according to claim 1. Advantageous embodiments have the features stated in the dependent claims.

According to the invention, it has surprisingly been found that impermeability or essential impermeability is a very advantageous property of an embossing belt according to the invention if the impermeable embossing belt is also used to convey a pressed paper web to the transfer nip adjacent to a Yankee cylinder in the dryer section of the paper machine. Owing to this property, vapour which because of the heating of the Yankee cylinder forms in the depressions or pits in the embossing pattern, of water in the pits or depressions, can be pressurised, which presses the paper fibres which are also present in the pits or the depressions because of the pressing effect of the press section, such that these, in the nip of the Yankee cylinder, are pressed into the pits or depressions while at the same time the fibrous web parts that are positioned between the elevation of the embossing pattern and the Yankee cylinder become thinner, thereby achieving the desired embossing effect and a high bulk of the paper web.

The embossing effect and productivity can be increased if the embossing belt or a layer thereof intended for contacting the paper web is also given the capability of reversible compressibility, such that the embossing belt is compressed in the transfer nip adjacent to the Yankee cylinder. When the embossing belt then leaves the transfer nip while resuming its non-compressed state, vacuum is generated and contributes to the formation of water vapour, which in turn results in, on the one hand, easier separation of embossing belt and paper web after the transfer nip and, on the other, quicker drying of the paper web on the Yankee cylinder, i.e. a higher paper production capacity. The vacuum generating effect becomes greater the quicker said resumption occurs, i.e. the more elastic the reversible compressibility is.

The embossing pattern of the embossing belt according to the invention is of course selected according to the desired embossed pattern of the paper that is to be manufactured. The embossing pattern is regular across the embossing belt or, if the embossed pattern of the paper web should comprise a distinguished additional pattern, such as a picture or logotype, it has a regular basic pattern of depressions or pits and elevations, on which pattern the additional pattern is superposed. By regularity is not necessarily meant regularity over all directions of the embossing belt. For instance, if the paper is soft tissue which is to be creped, a closer, dominant transverse (transversely of the machine direction) pattern, gives an increased crepe effect compared with a longitudinal pattern of depressions and pits. The properties of the paper can thus be changed in the desired direction by means of the pattern.

The embossing pattern can be provided in some prior-art manner with regard to the material of the embossing belt or its surface layer intended to engage the paper web, such as by etching, calendering, laser treatment or embossing.

The drying effect on the paper web on the Yankee cylinder can also be affected by the closeness of the embossing pattern. Thus, fewer contact points between the Yankee cylinder and the paper web produces a reduced drying effect of the Yankee cylinder, but an increased drying effect of the hot air hood round the Yankee cylinder on the fluffier parts of the paper web which extend between the thinner contact points.

Figure 3:
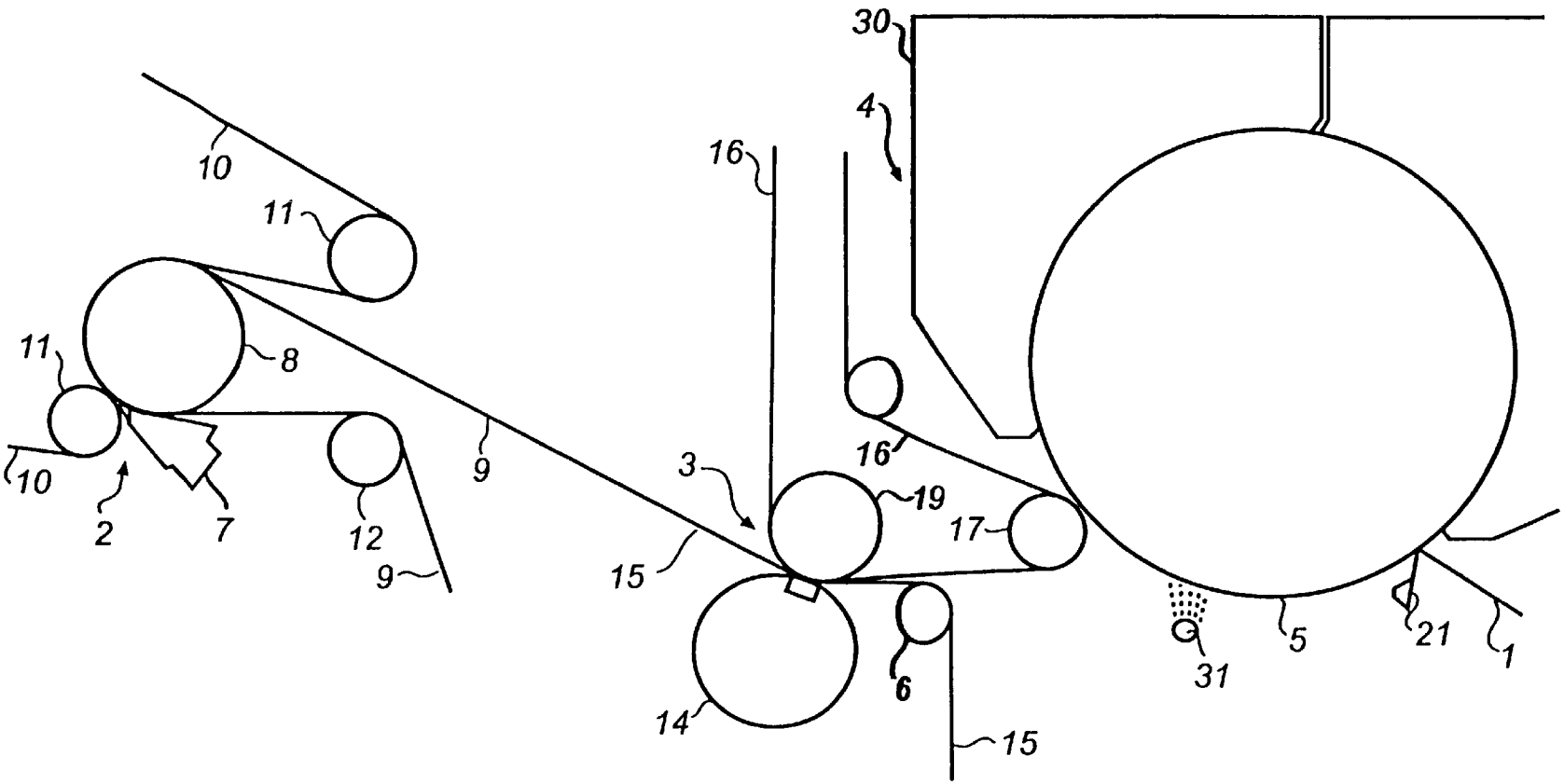
Figure 4:
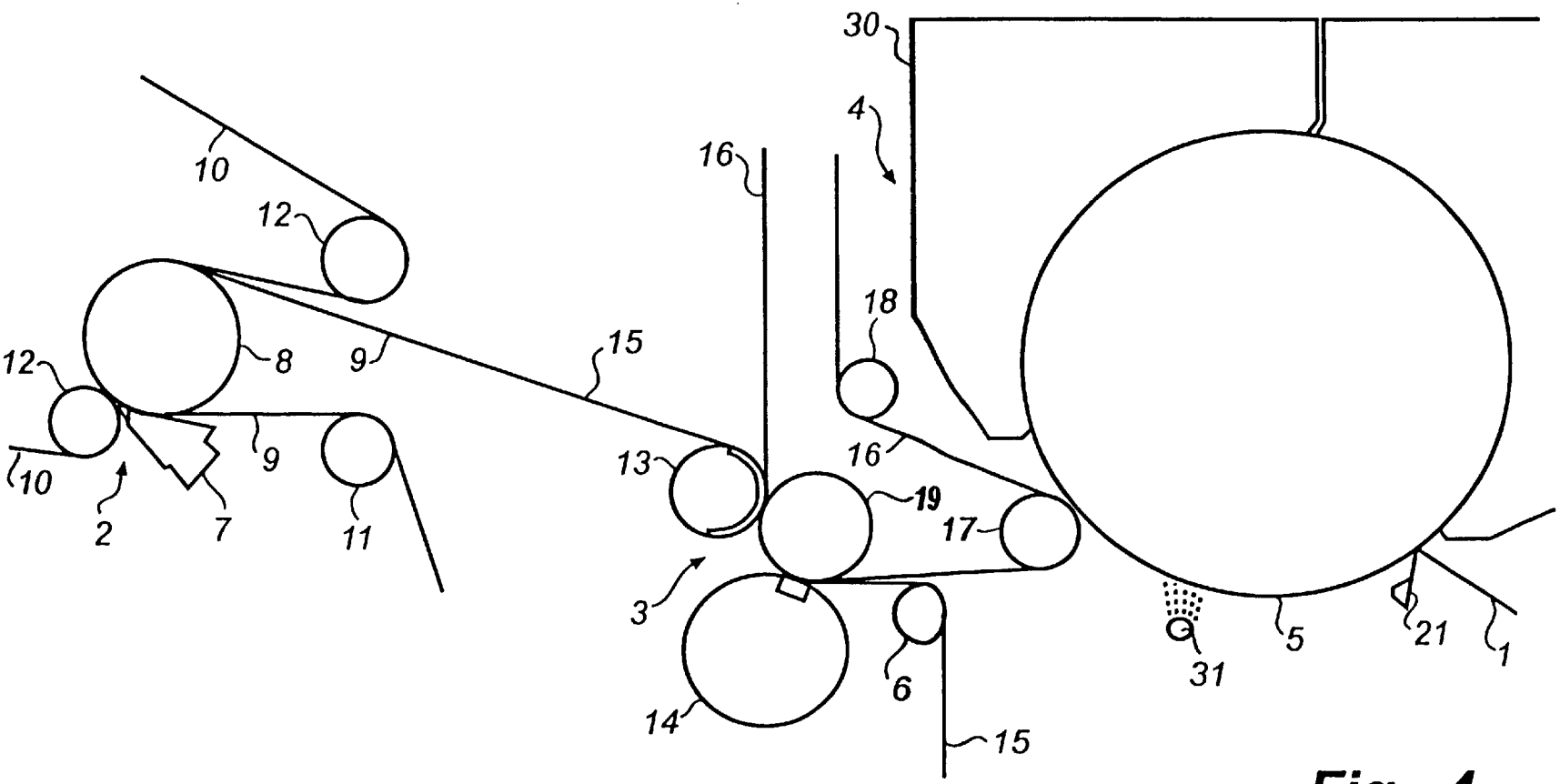
Figure 5:
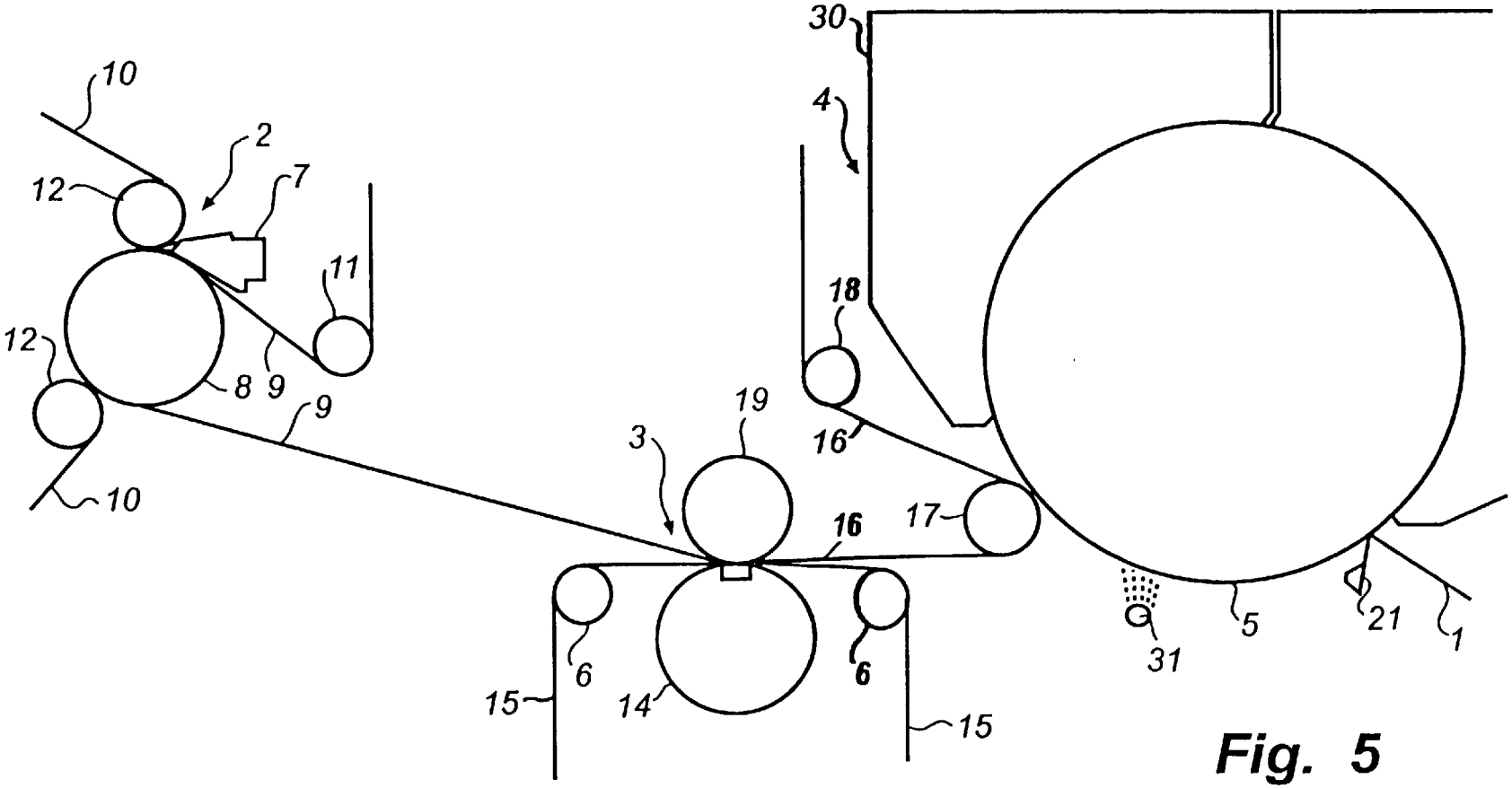
Figure 6:
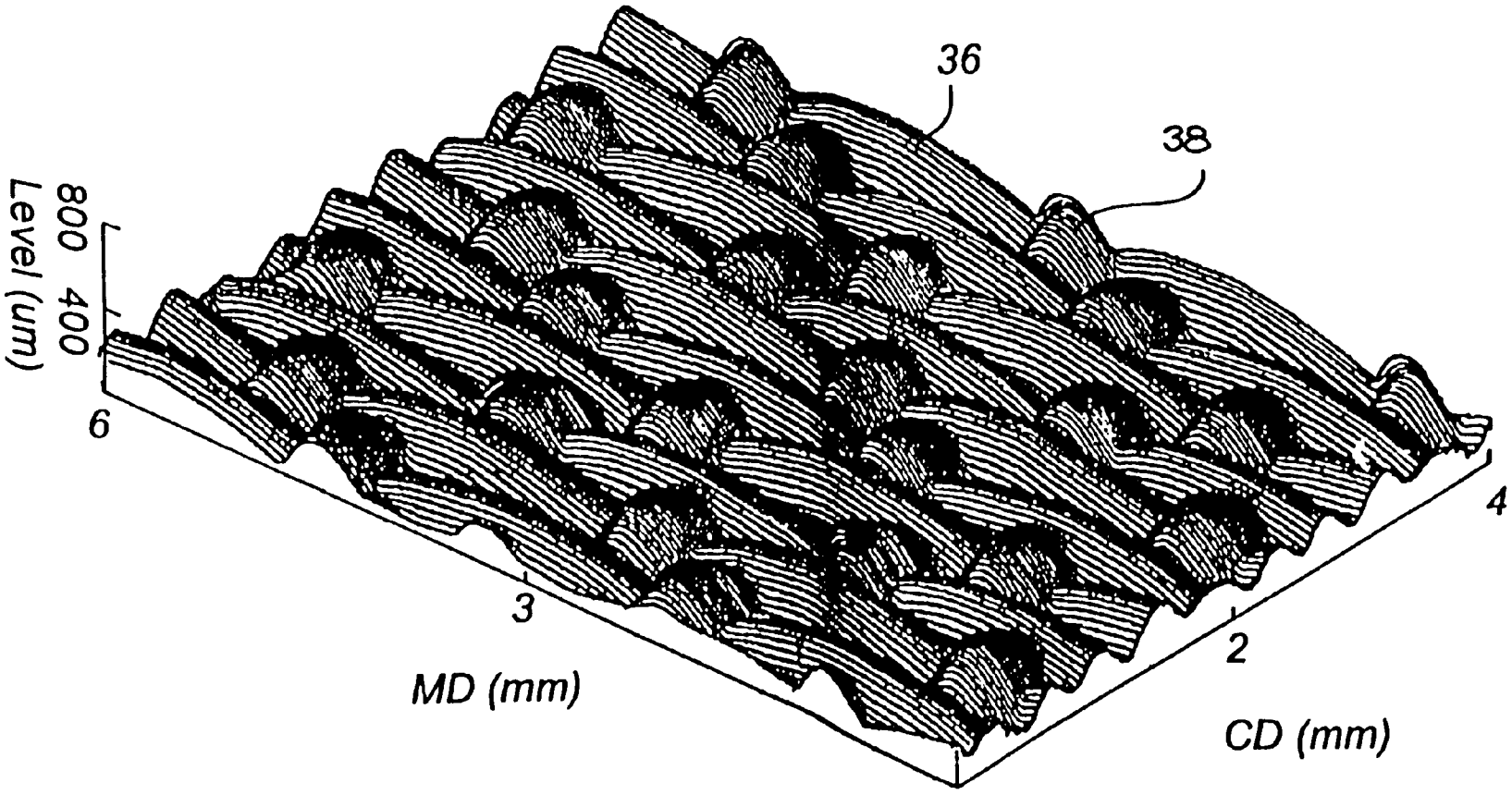
Figure 7:
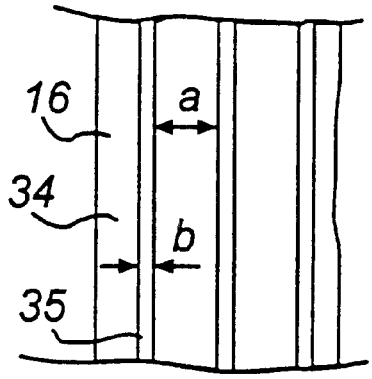
Figure 8:
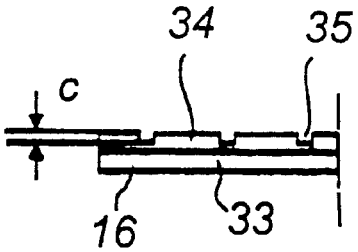
Figure 9:
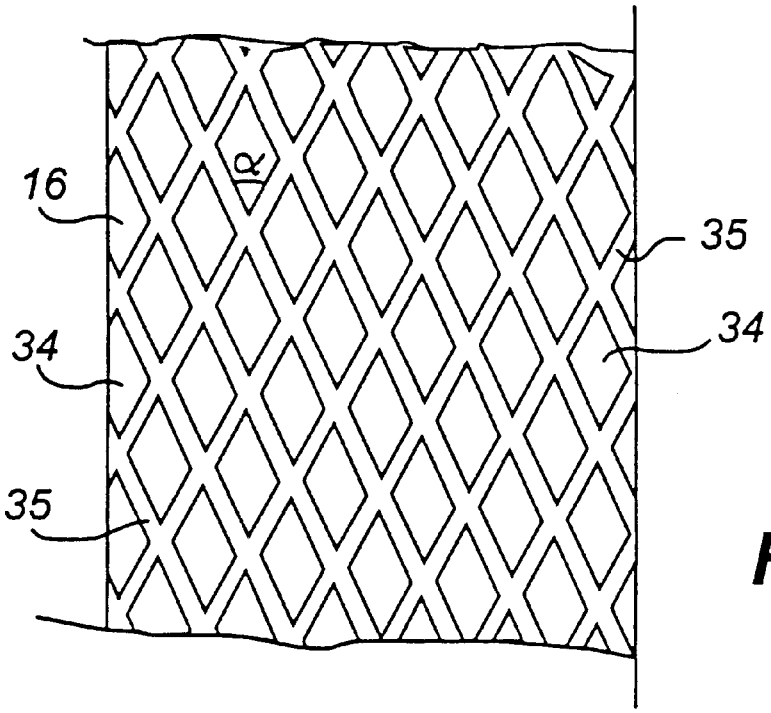

The invention will now be described in more detail with reference to the accompanying drawings, in which FIG. 1 shows a paper machine with an embossing and transfer belt according to the invention, FIG. 2 shows another paper machine with an embossing and transfer belt according to the invention, FIG. 3 shows a further paper machine with an embossing and transfer belt according to the invention, FIG. 4 shows one more paper machine with an embossing and transfer belt according to the invention, FIG. 5 shows one more paper machine with an embossing and transfer belt according to the invention, FIG. 6 is a perspective view of a portion of an essentially impermeable embossing belt according to the invention, which is constructed of a polymer-coated carrier in the form of a fabric coated on the back with a tight polymer layer, FIG. 7 is a top plan view of a portion of an essentially impermeable embossing belt according to the invention, which is constructed of a carrier provided with an elastic compressible polymer layer, the polymer layer having longitudinal grooves, FIG. 8 is a cross-sectional view of the embossing belt in FIG. 7, and FIG. 9 is a top plan view of a portion of an essentially impermeable embossing belt of the same type as the one in FIG. 7, but provided with diagonal intersecting grooves.

FIGS. 1–3 are schematic views of parts of paper machines for manufacturing an embossed fibrous web 1 of soft tissue, such as sanitary paper products. Each of the paper machines comprises a wet section 2, a press section 3 and a dryer section 4.

The wet section 2 comprises a head box 7, a forming roll 8, an endless, carrying inner clothing 9 and an endless, covering outer clothing 10, which consists of a forming fabric. The inner and the outer clothings 9, 10 each run in a loop round a plurality of guide rolls 11, 12.

The dryer section 4 comprises a Yankee type dryer cylinder 5 which is covered with a hood 30. At the exit side of the dryer section there is a crepe doctor 21 which is adapted to crepe off the fibrous web 1 from the Yankee cylinder 5. Moreover there is an application means 31 for applying a suitable adhesive to the circumferential surface of the Yankee cylinder 5 just before the transfer nip.

The press section 3 comprises a shoe press having a shoe press roll 14 and a counter roll 19, said rolls 14, 19 forming an extended press nip with each other. Moreover the press section comprises an endless press fabric 15 which runs in a loop round the guide rolls 6, and an endless, essentially impermeable embossing and transfer belt 16. The essentially impermeable belt 16 runs in a loop round the counter roll 19, a transfer roll 17 and a plurality of guide rolls 18.

The transfer roll 17 forms with the Yankee cylinder 5 a transfer nip with a low linear load, through which transfer nip thus runs the essentially impermeable belt 16.

In the embodiments shown in FIGS. 1 and 2, the press section 3 also comprises a press, the rolls of which consist of a suction press roll 13 and said counter roll 19 to form a press nip, through which the essentially impermeable belt 16 and the press fabric 16 run together with the fibrous web 1. After this initial press nip, the press fabric 15 is conducted away from the fibrous web 1 and the essentially permeable belt 16 in a side loop round the suction press roll 13 and two guide rolls 32. The press fabric 15 then again unites with the fibrous web 1 and the essentially impermeable belt 16 just before the extended press nip. If desired, suction means can be arranged in this side loop of the press fabric 15 in order to increase the water-absorbing capacity of the press fabric at the entry of the extended press nip.

In the embodiments shown in FIGS. 1 and 3, the inner clothing 9 of the wet section 2 is a fabric which is conducted to the press section 3 to be used also as a press fabric 15, and which thus in a loop runs back to the forming roll 8.

In the embodiment shown in FIG. 2, the inner clothing 9 of the wet section 2 is a fabric, the press fabric 15 running round a pick-up roll 20 which is arranged close to the loop of the fabric 9, such that the press fabric 15 and the fabric 9 run in contact with each other to transfer the fibrous web from the fabric 9 to the press fabric 15. The pick-up roll 20 can be provided with a suction shoe (not shown). Alternatively, the pick-up roll with suction shoe can be replaced by a pick-up suction box.

FIG. 4 is a schematic view of parts of a paper machine according to a further embodiment of the invention, which is similar to the one shown in FIG. 1 except that the press fabric 15 in this case is not conducted in a side loop between the two press nips, but instead follows the counter roll 19, such that the fibrous web 1 is kept enclosed between the essentially impermeable belt 16 and the press fabric 15. This embodiment can be used when there is a small risk of rewetting of the fibrous web.

In the embodiments according to FIGS. 1–4, the counter roll 19 is a smooth roll and is arranged in the loop of the essentially impermeable belt 16. In an alternative embodiment (not shown) of the press section according to FIG. 3, the positions of the rolls 14, 19 are inversed, i.e. the shoe press roll 14 is arranged in the loop of the essentially impermeable belt 16 and the counter roll 19 in the loop of the press fabric 15. In such a configuration, the counter roll can be a suction roll, a grooved roll or a blind bore roll.

FIG. 5 is a schematic view of parts of a paper machine according to a further embodiment of the invention for manufacturing an embossed fibrous web 1 of soft tissue, such as sanitary paper products. The paper machine comprises a wet section 2, a press section 3 and a dryer section 4. The wet section 2 comprises a head box 7, a forming roll 8, an endless, carrying inner clothing 9 and an endless, covering outer clothing 10, which consists of a forming fabric. The inner and outer clothings 9, 10 each run in a loop round a plurality of guide rolls 11, 12. The dryer section 4 comprises a dryer cylinder 5 which is covered with a hood 30. The dryer cylinder suitably is a Yankee cylinder. At the exit side of the dryer section there is a crepe doctor 21 which is adapted to crepe off the fibrous web 1 from the Yankee cylinder 5. Moreover there is an application means 31 for applying a suitable adhesive to the circumferential surface of the Yankee cylinder 5 just before the transfer nip. The press section 3 comprises a shoe press having a shoe press roll 14 and a counter roll 19, said rolls 14, 19 together forming an extended press nip. Moreover the press section comprises an endless press fabric 15 running in a loop round guide rolls 6, and an endless, essentially impermeable belt 16 which according to the invention is an embossing belt. The essentially impermeable embossing belt 16 runs in a loop round the counter roll 19, a transfer roll 17 and a plurality of guide rolls 18. The transfer roll 17 forms with the Yankee cylinder 5 a transfer nip having a low linear load, through which transfer nip thus runs the essentially impermeable embossing belt 16. In this embodiment, use is made of the essentially impermeable embossing belt 16 also as the inner clothing 9 of the wet section 2 by its loop being extended to the forming roll 8, whereby the essentially impermeable embossing belt 16 runs in a loop between the wet section 2 and the dryer section round the transfer roll 17, the guide rolls 18, 11 and the forming roll 8. The essentially impermeable embossing belt carries the fibrous web on its underside from the forming roll to the dryer cylinder.

In the embodiments according to FIGS. 1–5, the counter roll 19 is a smooth roll and is arranged in the loop of the essentially impermeable embossing belt 16. In an alternative embodiment (not shown) of the press section according to FIGS. 3 and 5, the positions of the rolls 14, 19 are inversed, i.e. the shoe press roll 14 is arranged in the loop of the essentially impermeable embossing belt 16 and the counter roll 19 in the loop of the press fabric 15. In such a configuration, the counter roll can be a suction roll, a grooved roll or a blind bore roll.

The essentially impermeable embossing belt, which is used in the above described embodiments of the inventive paper machine, comprises a rear layer 33 and a web-contacting layer 34 which has a large number of uniformly distributed depressions 35 and, positioned therebetween, flat or curved surface portions 36, 38, see FIGS. 6–9.

According to a first embodiment as shown in FIG. 6, the essentially impermeable embossing belt 16 consists of a tight layer which forms said rear layer 33, and a fabric which forms said web-contacting layer 34. The fabric 34 is on its web-contacting surface coated with a polymer which encloses the threads of the fabric without changing the geometric structure of the fabric, which is formed of depressions 35 and, positioned therebetween, curved or convex surface portions 36, 38, said depressions 35 and surface portions 36, 38 in their turn being formed of the threads of the fabric which extend in the machine direction and transversely thereof. The depressions 35 are closed by the tight rear layer 33 which is formed by the coating of polymer on the non-web-contacting surface of the fabric. Said curved surface portions 36, 38 comprise on the one hand elongate arcuate ridges 36 of the longitudinal fabric threads and, on the other hand, knuckles 38 of the transverse threads, said knuckles, in the embossing operation, giving the fibrous web small cup-shaped pits. In the embodiment shown in FIG. 6, the essentially impermeable embossing belt has 100 knuckles 36*b* per $cm^2$. It may generally have 25–150 knuckles/$cm^2$, preferably 50–100 knuckles/$cm^2$. This structure of depressions, ridges and knuckles forms a corresponding embossed pattern in the fibrous web when this together with the embossing belt 16 and the press fabric 15 runs through the extended press nip.

The polymer coating of the fabric causes the fibrous web to reliably adhere to the essentially impermeable embossing belt when the fibrous web leaves the extended press nip. This ensures that the fibrous web follows the essentially impermeable embossing belt 16 and not the press fabric 15. The structure of the web-contacting layer of the essentially impermeable embossing belt, i.e. the polymer-coated fabric 34, also implies, in combination with the circumferential surface of the dryer cylinder 5 being coated with a continuous adhesive layer, that the fibrous web is reliably transferred to the dryer cylinder 5 when the fibrous web runs through and out of the transfer nip.

As fabric in the above-described first embodiment of the essentially impermeable embossing belt, it is possible to use the fabric that is Generally referred to as a coarse single-layered fabric which has 100 knuckles/cm$^2$. The rear layer, which is essentially impermeable, may consist of a suitable polymer material, for instance the polymers described below for the polymer layer of the second embodiment of the essentially impermeable embossing belt. The polymer for coating the fabric threads can be selected in the same way.

According to a second embodiment, the essentially impermeable embossing belt 16 consists of a carrier which constitutes the rear layer 33, and a polymer layer 34 on the web-contacting side of the carrier having a hardness of 50–97 Shore A, the polymer coating having a non-compressed degree of roughness of $R_z$=2–80$\mu$m, measured according to ISO 4287, Part I, and being compressible to a lower degree of roughness of $R_z$=0–20$\mu$m when a linear load of 20–200 kN/m is applied to the essentially impermeable embossing belt, and can be reset to its non-compressed degree of roughness when the pressure acting on the essentially impermeable embossing belt ceases. The $R_z$ value is more specifically the ten point height which in this ISO standard is defined as the average distance between the five highest crests and the five deepest troughs of the reference length that is measured from a line which is parallel with the centre line and does not intersect the surface profile. Preferably the essentially impermeable embossing belt has an air permeability which is less than 6 m$^3$/m$^2$/min measured according to "Standard Test Method for Air Permeability of Textile Fabrics, ASTM D 737–75, American Society of Testing and Materials".

The essentially impermeable embossing belt 16 thus is compressible under the action of the press forces prevailing in the extended press nip. The essentially impermeable embossing belt 16 therefore assumes a non-compressed state upstream and downstream of the extended press nip and a compressed state when it passes the extended press nip, in which case the surface, the web-carrying surface, which faces the fibrous web has a high degree of roughness in the non-compressed state of the essentially impermeable embossing belt and a lower degree of roughness in the compressed state of the essentially impermeable embossing belt such that the web-carrying surface in the compressed state of the essentially impermeable embossing belt is sufficiently smooth for a continuous liquid film to form on the web-carrying surface when the essentially impermeable embossing belt together with the press fabric 15 and the fibrous web 1 runs through the extended press nip, and such that the web-carrying surface in the non-compressed state of the essentially impermeable embossing belt is sufficiently coarse for the continuous liquid film to be broken after the expansion of the essentially impermeable embossing belt in the direction of thickness.

The compressible polymer layer 34 has said uniformly distributed depressions 35 which are present in a large number to receive a great part of the web-contacting surface, viz. from 30% up to 70%. The depressions 35 can be designed in many different ways to achieve the desired effect of embossing a relief pattern in the fibrous web, thereby increasing the bulk thereof. The depressions may consist of continuous grooves in the polymer layer 33, see FIG. 7, which extend in the machine direction. According to another embodiment, the grooves extend diagonally from one edge to the other, in which case they make an angle of 10–80° with the machine direction. According to a further embodiment, see FIG. 8, the depressions consist of diagonal intersecting grooves which in a group extend from the first edge to the second and in another group from the second edge to the first, in which case two intersecting grooves make an angle $\alpha$ of 10–170°. The grooves in the different embodiments can be straight, as illustrated, undulated or the like, for instance sinusoidal or zigzagged. The distance a between two grooves 35 extending in the same direction can be the range of 1–3 mm. The width b of the groove is in the range of 0.5–1.0 mm and the depth c in the range of 0.1–1.0 mm.

According to a further embodiment (not shown), the depressions consist of cavities of the same or different shape. The cavities can be circular, elliptic, polygonal, for instance triangular, rectangular or hexagonal, the greatest dimension being in the range of 0.5–3.0 mm and the depth in the range of 0.5–1.0 mm.

All or some of the depressions, individually or in groups, may further consist of cavities of special symbolic shapes, such as figures, letters or product or firm symbols, which within a unit of length of the belt can be repeated at regular intervals.

The essentially impermeable embossing belt according to said second embodiment can be composed according to the formulations described in U.S. Pat. No. 5,298,124 discussed by way of introduction. The polymer layer 34 comprises a polymer composition, such as acryl polymer resin, polyurethane polymer resin and polyurethane/polycarbonatepolymer resin composition. The polymer layer also comprises a particulate filler which has a hardness different from that of the polymer material and which may be, for instance, kaolin clay, polymer material or metal, preferably stainless steel. The carrier, which constitutes the rear layer 33, comprises all types of base elements which are in some way made endless. The expression also comprises seamed base elements. The carrier may consist of, for instance, a single- or multi-layered woven fabric made of polymer monofilament yarn such as polyester, polyamide and the like. The base element may also consist of a fibrous web (nonwoven) kept together by a binder, joined wound threads, polymer foil/film, warp knit or the like. The carrier can be coated on the back with a polymer material of the same type as used for the polymer layer 34.

It is surprising that such a transfer belt, which according to U.S. Pat. No. 5,298,124 is intended for pressing in a press section and usable for transfer of a paper web from the press section to a dryer fabric, is advantageously usable for embossing and transfer of a soft tissue web from a shoe press nip directly to a Yankee cylinder. In a Yankee cylinder, the conditions are, in fact and as is known, completely different from those in a conventional press nip. In a Yankee cylinder, no pressing of the soft tissue web for direct dewatering occurs, but instead it is a matter of supporting the soft tissue web against the outer surface of the Yankee cylinder, such that the fibres of the soft tissue web adhere to the surface of the Yankee cylinder to get stuck by burning, thereby obtaining good thermal transmission to the paper web. Precisely this effect is achieved by the inventive transfer belt, but cannot be achieved by using a press felt according to DE 195 48 747 owing to the above-mentioned rewetting of the paper web after the last press nip in the press section, which prevents good adhesion, and cannot be achieved or is achieved to a substantially smaller extent by using a transfer belt according to U.S. Pat. No. 5,393,384, for the reason described above. The compressibility of the inventive transfer belt results in a lower specific pressure in the adhesion point, which in turn entails increased runnability, i.e. a higher production rate. Moreover, this property results in increased evaporation of water from the soft tissue web, i.e. quicker drying of the soft tissue web on the Yankee cylinder, which also promotes a higher rate of production.

A paper machine which is provided with the inventive embossing belt and whose press nip/nips is/are single-felted, produces an embossed fibrous web which before the dryer section has a high dry solids content, viz. up to 55%, which is to be compared with the dry solids contents of up to 45% that can be achieved in paper machines that are currently used in practice. This improvement can be used either to operate the paper machine with a higher rate of production or to reduce the consumption of energy en the dryer section, in which case it is also possible to reduce the diameter of the dryer cylinder.

In the embodiments described and illustrated, a guide roll can, if desired, be arranged in the loop of the essentially impermeable embossing belt 16 just before the transfer roll 17.

In the embodiments described and shown, use is made of a transfer means which consists of the transfer roll 17. According to an alternative embodiment (not shown), the transfer roll is replaced by the essentially impermeable embossing belt itself, which is allowed to run round a predetermined part of the dryer cylinder, e.g. in a sector angle of 30–60°, with a view to forming an extended transfer nip with the dryer cylinder.

Although the above-described embodiments of the paper machine have press sections which all comprise a shoe press, the invention is applicable also when the press section has no shoe press and instead has at least one press with two press rolls, of which the press roll round which the press fabric runs is a suction roll, a grooved roll or a blind bore roll.

The invention has been described above in most cases in connection with a paper machine for manufacturing embossed soft tissue. However, the embossing belt is usable also in the production of any other type of embossed paper, such as embossed normal paper, embossed sack kraft paper, in which case a type of device other than a Yankee cylinder is used for the drying of the paper web.

What is claimed is:

1. An embossing belt for a paper machine, intended to run through a press section in the paper machine together with a fibrous web and produce embossment thereof in the press section, and to transfer the embossed fibrous web from the press section directly to and through a transfer means in the dryer section of the paper machine, characterised in that it is essentially impermeable and comprises a rear layer (33) and a web-contacting layer (34), which has a large number of uniformly distributed depressions (35) and, positioned therebetween, surface portions (36) for forming a corresponding relief pattern in the fibrous web passing through the press section, that said rear layer (33) is a carrier and that said web-contacting layer (34) is a compressible polymer layer having a hardness of between 50 and 97 Shore A, said polymer layer having a web-contacting surface which has a pressure-sensitive, resettable degree of roughness, the web-contacting surface having a degree of roughness in a non-compressed state of $R_z$=2–80$\mu$m, and a lower degree of roughness of $R_z$=0–20$\mu$m when the polymer layer is compressed by a linear load of 20–220 kN/m applied to the essentially impermeable embossing belt as measured in a non-extended press nip.

2. An embossing belt for a paper machine, intended to run through a press section in the paper machine together with a fibrous web and produce embossment thereof in the press section, and to transfer the embossed fibrous web from the press section directly to and through a transfer means in the dryer section of the paper machine, characterised in that it is essentially impermeable and comprises a rear layer (33) and a web-contacting layer (34), which has a large number of uniformly distributed depressions (35) and, positioned therebetween, surface portions (36) for forming a corresponding relief pattern in the fibrous web passing through the press section, that said rear layer (33) is an essentially impermeable layer and that said web-contacting layer (34) is a fabric which is coated with a polymer without concealing the geometric structure of the fabric, said structure being formed of said depressions (35) and, positioned therebetween, surface portions (36) which have curved or convex shapes.

3. An embossing belt as claimed in claim 2, characterised in that said curved or convex surface portions (36) comprise a plurality of knuckles **(36*b*)**, which are formed of fabric threads extending in one and the same direction, and are uniformly distributed in a number of 25–150 knuckles/cm$^2$.

4. An embossing belt as claimed in claim 1, characterised in that the depressions (35) receive from 30% up to 70% of the web-contacting surface.

5. An embossing belt as claimed in claim 1, characterised in that the depressions (35) consist of continuous grooves in the polymer layer (34), said grooves (35) being arranged in one or more groups, the grooves in one and the same group extending in the same direction.

6. An embossing belt as claimed in claim 5, characterised in that the distance (a) between two grooves (35) in the same group is in the range of 1–3 mm, and that the width (b) of the groove is in the range of 0.5–1.0 mm and the depth (c) in the range of 0.1–1.0 mm.

7. An embossing belt as claimed in claim 5, characterised in that the grooves (35) extend in the machine direction or make an angle therewith of 10–80°.

8. An embossing belt as claimed in claim 5, characterised in that the grooves (35) are arranged in a first group, in which the grooves extend in one and the same direction, and a second group in which the grooves extend in one and the same direction, which makes an angle $\alpha$ with the direction of the grooves in the first group, said angle $\alpha$ being 10–170°.

9. An embossing belt as claimed in claim 5, characterised in that the grooves (35) are straight.

10. An embossing belt as claimed in claim 1, characterised in that the depressions (35) consist of cavities of the same or different geometric shapes comprising a circle, ellipse, polygonal, each having a greatest dimension in the range of 0.5–3.0 mm and a depth in the range of 0.5–1.0 mm.

11. An embossing belt as claimed in claim 1, characterised in that at least some of the depressions (35) consist of cavities of non-geometric symbolic shapes and comprising figures, letters or product or firm symbols with a depth in the range of 0.5–1.0 mm.

12. An embossing belt as claimed in claim 1, characterised in that the essentially impermeable embossing belt (16) has an air permeability of less than 6m$^3$/m$^2$ /min.

13. An embossing belt as claimed in claim 1, characterised in that the transfer means consists of the essentially impermeable embossing belt (16), which runs round a predetermined part of a dryer cylinder (5) in the dryer section to form an extended transfer nip.

14. An embossing belt as claimed in claim 3, wherein said plurality of knuckles **(36*b*)**, are uniformly distributed in a number of 50–100 knuckles/cm$^2$.

15. An embossing belt as claimed in claim 5, characterised in that the grooves (35) are undulated.

* * * * *